US008108945B2

(12) United States Patent
Sanchez

(10) Patent No.: US 8,108,945 B2
(45) Date of Patent: Feb. 7, 2012

(54) KNEE POCKET SYSTEM

(76) Inventor: Jorge A. Sanchez, Miami, FL (US)

( * ) Notice: Subject to any disclaimer, the term of this patent is extended or adjusted under 35 U.S.C. 154(b) by 5 days.

(21) Appl. No.: 12/457,526

(22) Filed: Jun. 15, 2009

(65) Prior Publication Data

US 2010/0313322 A1 Dec. 16, 2010

(51) Int. Cl.
*A41D 13/00* (2006.01)

(52) U.S. Cl. ..... 2/24

(58) Field of Classification Search ..... 2/22, 23, 2/24, 455, 16, 59, 267, 21, 46; 128/878, 128/881, 882; 602/23, 26, 62
See application file for complete search history.

(56) References Cited

U.S. PATENT DOCUMENTS

| | | | | |
|---|---|---|---|---|
| 4,613,991 | A * | 9/1986 | Grover | 2/23 |
| 4,831,666 | A * | 5/1989 | Denman | 2/23 |
| 4,920,577 | A * | 5/1990 | Scharf | 2/24 |
| 5,105,473 | A * | 4/1992 | Valtakari | 2/461 |
| 5,920,902 | A * | 7/1999 | Crampton | 2/24 |
| 6,014,771 | A * | 1/2000 | Kirven | 2/23 |
| 7,793,359 | B2 * | 9/2010 | Spiewak et al. | 2/69 |

* cited by examiner

*Primary Examiner* — Tejash Patel

(57) ABSTRACT

The invention entitled Knee Pocket System is a pocket design that includes; a pocket made of durable material, stitches, a locking device and a uniquely fitted comfort pad. The said invention is attached to a garment, a garment consisting of two pant legs of equal length surpassing the knees and reaching the ankles in most cases; in this case a pant garment. Identical shaped pocket designs are stitched to the exterior knee area of each pant leg. A locking device opens and closes the top edge of the pocket design allowing a uniquely fitted comfort pad to be implanted or removed at will. The said invention provides comfort and protection for the knees while walking in the park, while playing in the playground or while kneeling part time or full time at work.

5 Claims, 5 Drawing Sheets

KNEE POCKET SYSTEM

BACKGROUND OF THE INVENTION

It has been my observation and evaluation as the inventor of the invention entitled Knee Pocket System that my invention is a necessity and not a luxury. The said invention generally relates to a pocket design attached to a garment, a garment consisting of two pant legs of equal length surpassing the knees and reaching the ankles in most cases (jump suits, jeans, work pants, overalls, chaps, baby pants or suit, scrub pants, casual pants, military pants or any other similar pant garment), in this case in order to describe the said invention the garment is an all-purpose pant.

Identical shaped pocket designs are sized and created proportionately for each pant leg and stitched to the exterior knee area. The placement around the knee area will always be in a position that avoids any discomfort while a person is standing or kneeling. A locking device (preferably a zipper) is located at the top edge of each pocket design allowing the pocket to be opened and closed for a uniquely fitted comfort pad (durable, lightweight elastomeric foam is preferred). This comfort pad (our name for the kneepad) is matched to the dimensions of the pocket design, but slightly smaller. Each uniquely fitted comfort pad can be implanted or removed at will providing the knees with padded comfort and protection. The combined pocket design elements of the said invention give a pant garment a unique quality of appearance and a unique quality of utility. A pant garment can be worn with the Knee Pocket System for casual, for play or for work activities. People gain some added degree of comfort and some added degree of protection from rigid surfaces in case of accidental falls, from rigid surfaces during spontaneous kneeling and/or from rigid surfaces while kneeling part time or full time during work hours.

Problems associated with prior art are centered around kneepad replacement if not encased, kneepad movement and/or dislodgment, bulky or clumsy pant garments created by different kneepad arrangements and in many instances the need to carry additional kneepad equipment. Straps or too much material at the knee area can create discomfort and inconvenience making the pant garment awkward during standing and/or kneeling. The focus of prior art is mostly on a particular group of users; prior art fails to address the real needs of excluded users. The Knee Pocket System improves the approach to comfort, to protection and to convenience with reliability for everyone.

Many activities in the general population would benefit from our invention entitled Knee Pocket System. Most skateboarders (usually) do not wear any form of added knee comfort or added knee protection. And if they do wear some type of added comfort and protection, they wear bulky uncomfortable knee-padded equipment with straps. Skateboarders need to have comfort and protection for their knees, but without the anomaly that available products provide. The Knee Pocket System is a comfort and protection system that does not hinder their flows of movement. They simply wear a garment (in this case all-purpose pants) with the said invention attached to the garment (there is no discomfort, there is no inconvenience). It is a comfortable and protective way for skateboarders to maximize their activity in a safer, but natural way.

Police officers, firemen, and rescue personnel are often called to an emergency of one kind or another. Without a moment's notice or for a fraction of time the events require that they kneel; up to now they just kneel and wish they had been equipped with additional comfort and with additional protection for their knees (spontaneous kneeling occurs often during the course of events). The said invention is an unobtrusive invention that becomes a subtle part of a pant garment. It can equip these particular users with a pant garment that will provide the comfort and protection that they need. When they find themselves kneeling the said invention performs its utility and for the moments that they are not kneeling the said invention becomes a subtle part of their uniform creating no interference with their normal movement of walking and/or running.

Toddlers can have the said invention attached to a pant garment that they might wear during their crawling phase. Construction crews; floor installers; painters; roofers and other people performing a trade can have the said invention conform to their kneeling needs (of part time kneeling or full time kneeling). Kids and teenagers playing in the playground can play and run without being hindered while wearing a pant garment that includes the Knee Pocket System. A mechanic all of sudden needs to look under a car; while wearing a pant garment with the said invention, his kneeling is performed with added comfort and added protection. Other users can be photographers while filming a sporting event; stagehands while moving a staged concert; a gardener while planting vegetation; landscapers; soldiers; doctors; reporters; baseball players and golfers. These examples are just a few, but there are many circumstances that are prime examples of how such an invention improves the way people can live and/or do their work. The Knee Pocket System offers an option of unique improvement without a question. Whether the kneeling needs are casual or complicated, spontaneous or planned these needs are addressed by the Knee Pocket System.

The said invention is unique in its design and in its utility. No prior art (from Walther 514,576 A—through the more recent prior patents for this category) has the construction and/or design emphasis as the said invention. No prior art addresses the issues of major kneepad movement, of kneepad replacement and/or kneepad dislodgment as the said invention. And no prior art addresses the different work, play or casual needs of different age groups and/or work groups in the same way as the said invention. The Knee Pocket System is intended for a wide range of people needing some degree of added comfort and some degree of added protection for their knees. It does not limit itself by meeting the needs of a specific group or groups of people, such as, people that work in a trade. A person can wear a pant garment with the Knee Pocket System while walking in the park, while playing in the playground or while working on their knees part time or full time. The pant garment will not be made bulky, clumsy or inconvenient to wear because of the said invention. Instead, the pant garment will be simply attractive to wear with a utility feature that is both functional and unobtrusive.

SUMMARY OF THE INVENTION

The objective of the invention entitled Knee Pocket System is to apply some added degree of comfort and some added degree of protection to the exterior knee areas of a person's garment (in this case all-purpose pants). Improvements from past knee-padded arrangements are distinct and unique. The appearance of the invention entitled Knee Pocket System can have subtle fashion or distinct fashion integrated into the everyday style of a pant garment. Its utility conforms to different activities (casual, play or work) without overwhelming the pant garment.

Other past knee-padded arrangements are complicated and/or cause some type of inconvenience. Most of those knee-padded arrangements are attached to the seams of the pant garment creating a buildup of material to the sides of the knee area when the knee is bent. This additional material buildup can irritate the user more than it can provide comfort or protection. It has been our experience that the important area to provide comfort and protection is the front knee area alone. The Knee Pocket System does that by bringing the lateral edges of the pocket design closer together away from the seams and stitching the pocket design to the pant garment with an equal strength to that of the strength provided by the seams. The said invention will be proportionate in its dimensions to that of the pant garment size, thus eliminating any issues that concern adjusting the comfort pad (our name for the kneepad) vertically or horizontally. Because the comfort pad will be uniquely fitted to the dimensions of the said invention minimal movement is achieved. What is created by the said invention is full coverage of the front exterior knee area with durable comfort, with durable protection and with durable convenience while a person is standing or kneeling. A pant garment with the Knee Pocket System can be worn and cleaned like any typical pant garment. People would acquire intangible comforts with our said invention, which alone is important.

Other past knee-padded arrangements have failed to address the wide range of activities. Our said invention will bring a benefit to all those who seek convenience with added comfort and added protection for their knees. The Knee Pocket System addresses all the intricate knee comfort and protection issues with improvement. It improves the issues of kneepad security (major movement or dislodgment) and kneepad replacement and/or removal with added convenience like no other pocket design in the past. Uniquely fitted comfort pads (our name for the kneepad) create no need for adjustment vertically or horizontally and no need for additional folds in the material. It is more practical, durable and reliable for different types of environments. When, where and how much the said invention is used depends on a person's activity. Additional comfort and additional protection for the exterior knee areas of a pant garment are achieved without additional knee-padded equipment with uncomfortable straps; without additional bulky or clumsy work pants; without additional buckles, buttons, snaps or glue to hold the pad or pocket in place; or without additional required changing into other pants due to uncomfortable padding (because the padding is encased or cannot be removed with ease). The said invention embraces intangible comforts and improvements that no prior art can claim. Our invention entitled Knee Pocket System is intended for people of all ages who want some degree of additional comfort and some degree of additional protection for their knees. The appearance of pockets will give a pant garment a unique appearance that will blend with subtlety or will blend with distinct fashion. Toddlers; kids; teenagers and adults can have the said invention attached to their casual, play or work pants. The Knee Pocket System is a practical solution that is ergonomic in nature.

BRIEF DESCRIPTION OF THE DRAWINGS

For a better understanding of the said invention entitled Knee Pocket System we can refer to the accompanying drawings.

I claim the invention entitled Knee Pocket System as shown and described. It will be understood by those skilled in the field that modifications may be made to the said invention without departing from the scope of the said invention.

DETAILED DESCRIPTION OF THE DRAWINGS

It is to be made clear that the pant garment is not part of the claim; therefore, it is represented with broken lines.

Figure 1:
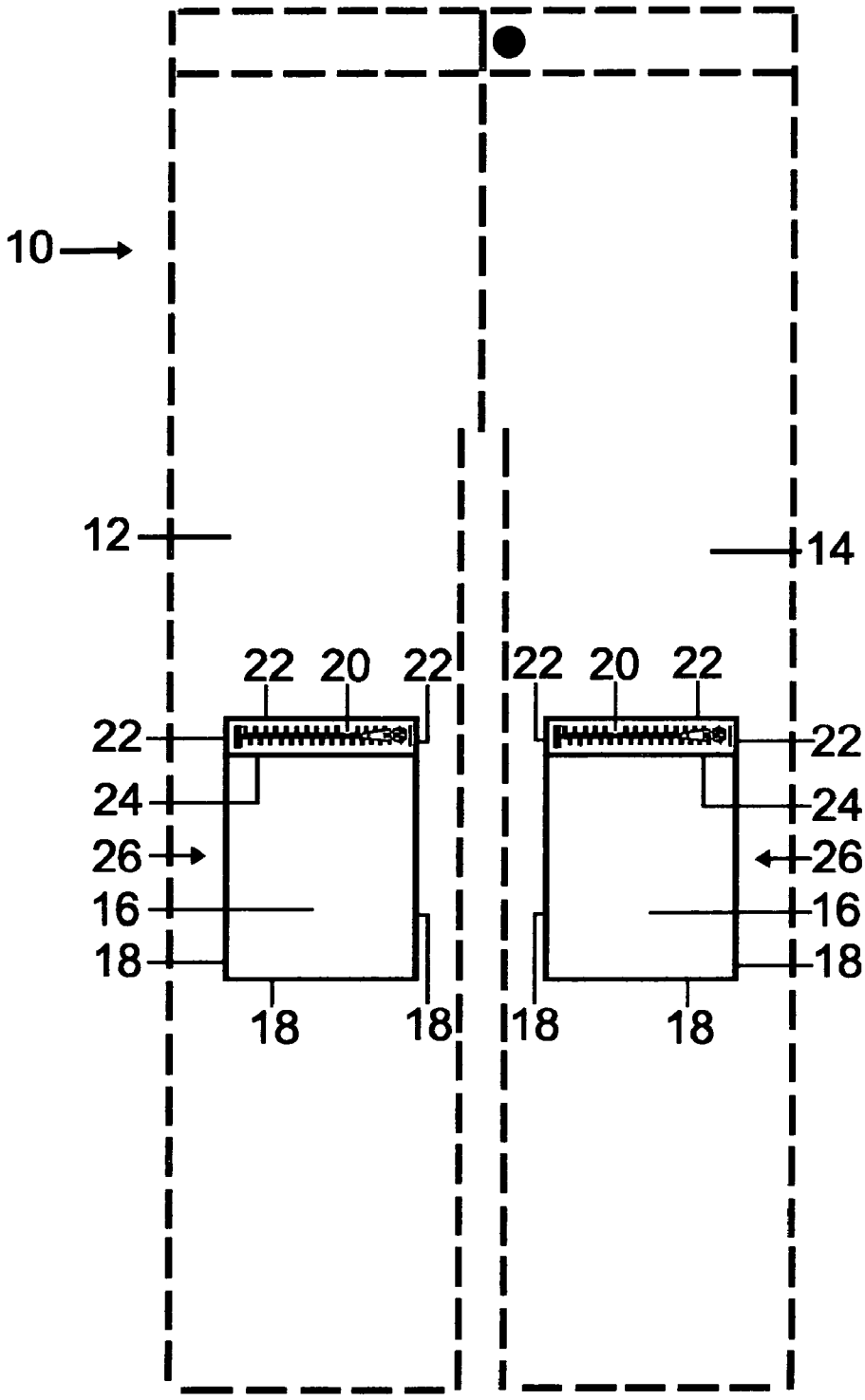
FIG. 1 is a front view of the Knee Pocket System attached to the exterior of each knee area of a pant garment. Broken lines show structure that is not part of the claim. The construction is as shown and described.

There is shown in FIG. 1 a garment 10 (in this case an all-purpose pant) that has two equal pant legs in length surpassing the knee area and reaching the ankles in most cases. Each pant leg 12 and 14 has durable material 16 (preferably leather) attached to the exterior knee area of the garment 10 by strong durable stitches 18. This durable material 16 (preferably leather) has strong durable stitching 18 at the side edges and at the bottom edge forming a vertical rectangular shape that is identical for each pant leg 12 and 14 and known as the pocket (made of durable material) 16. The top edge that remains unattached from the garment 10 is attached to a locking device 20 (preferably a zipper) that closes or opens the pocket 16. The edges of the locking device 20 are attached by stitches. The top edge and side edges of the locking device 20 are attached to the pant garment 10 by stitches 22. But the bottom edge of the locking device 20 is attached to the pocket (made of durable material) 16 by stitches 24. Locking device 20 is in between the pant garment 10 and the pocket 16. The width of the locking device 20 (preferably a zipper) is the full length of the width of the rectangular shape that forms the pocket 16.

Figure 2:
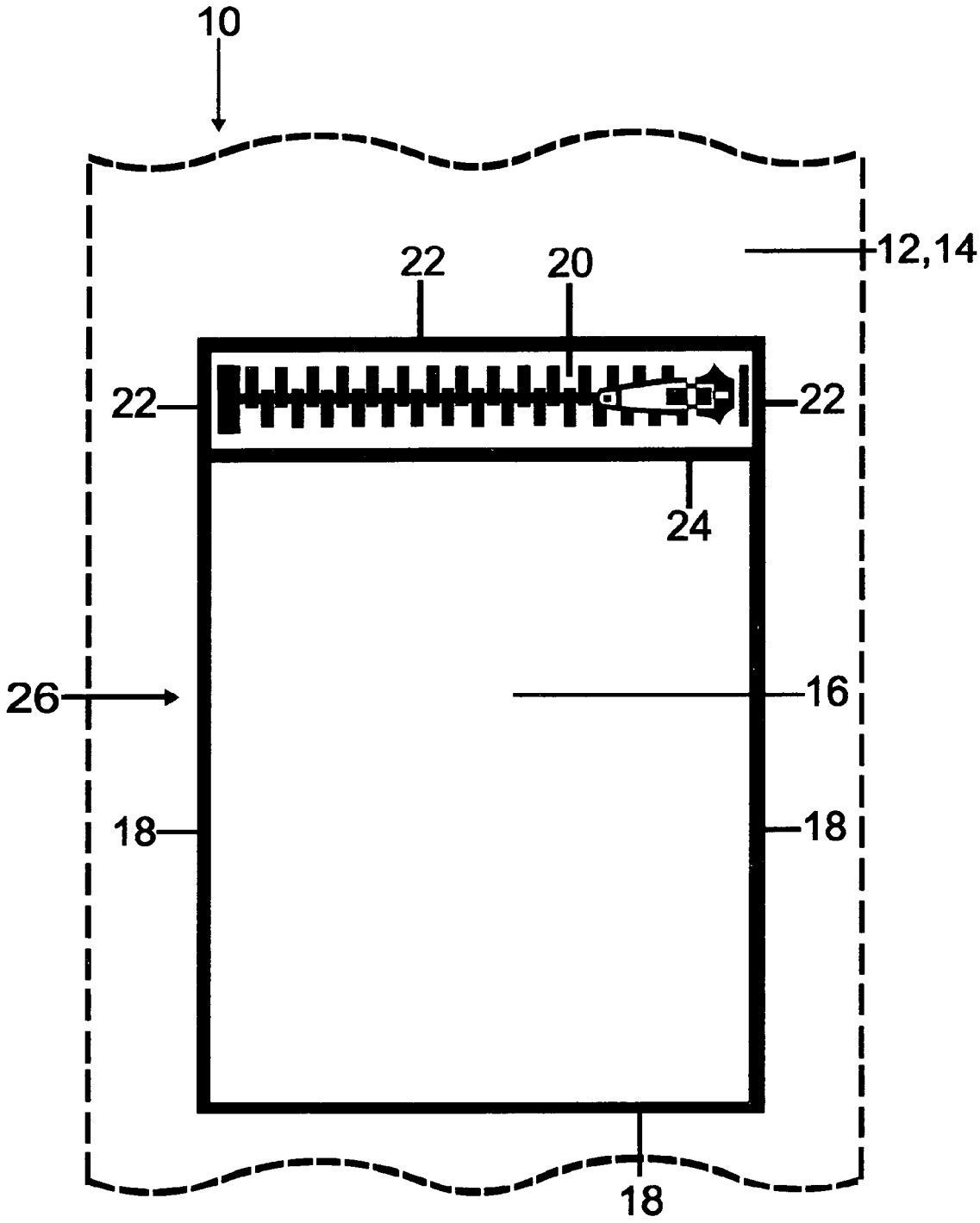
FIG. 2 is an enlarged fragmentary view of FIG. 1 of the Knee Pocket System in accordance with the construction of the said invention. Broken lines show structure that is not part of the claim. The construction is as shown and described.

Access into the pocket 16 is achieved at the top edge by opening or closing the locking device 20 (preferably a zipper) at will. It is shown in FIG. 2 an enlarged fragmentary view of FIG. 1 how the locking device 20 covers the full length of the width of the pocket 16. Strong durable stitches 22 attach the side edges and the top edge of the locking device 20 to the pant garment 10. The bottom edge of the locking device 20 is attached by durable stitches 24 to the pocket 16. Placement of the locking device 20 and the pocket 16 will always be placed around the knee area along each pant leg 12 and 14 in a position that avoids any discomfort while a person is standing or kneeling.

Figure 3:
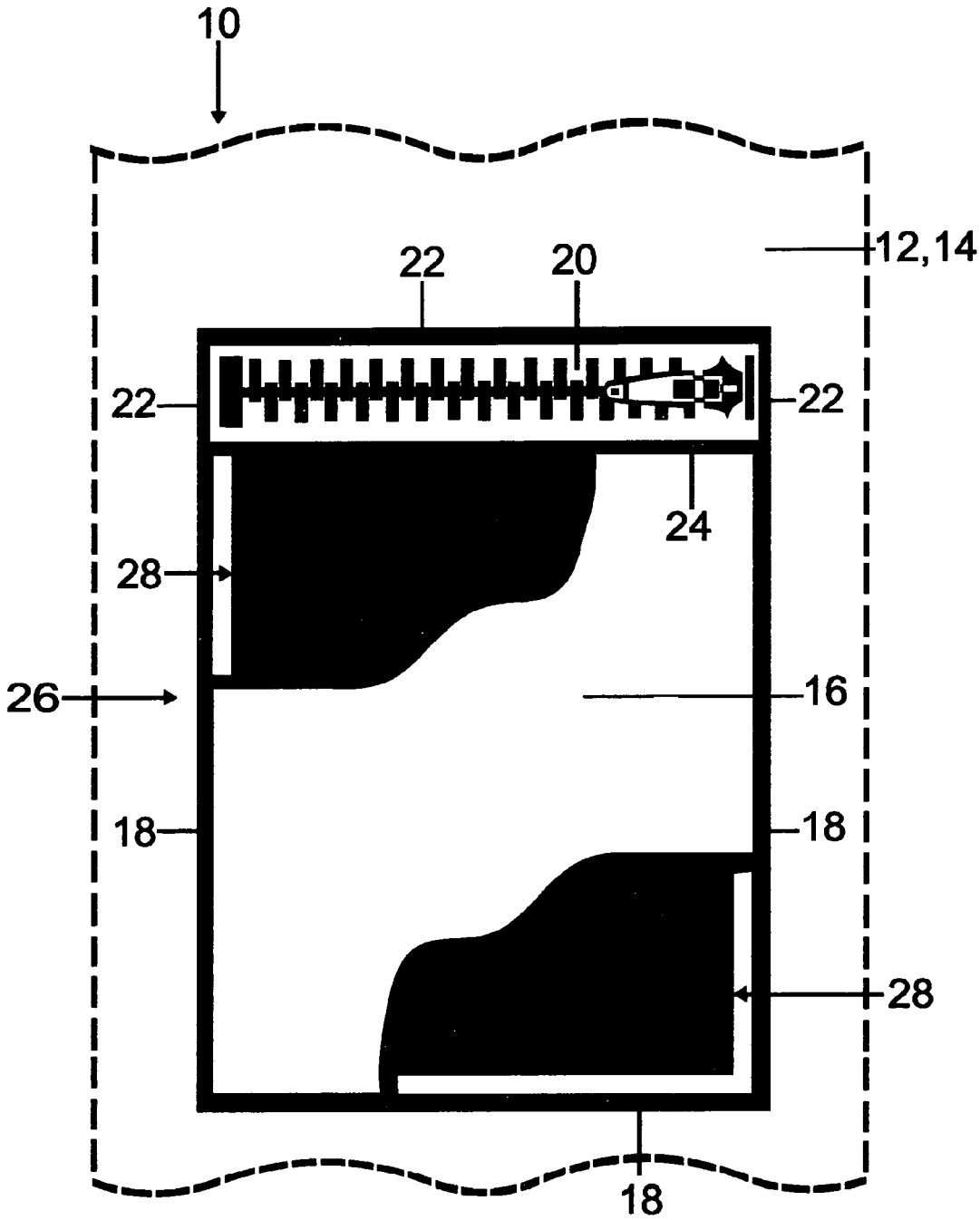
FIG. 3 is an enlarged fragmentary view of FIG. 1 of the Knee Pocket System in accordance with the construction of the said invention. In this view we see a comfort pad uniquely fitted within the pocket reaching behind the locked locking device of the Knee Pocket System as shown and described. Broken lines show structure that is not part of the claim.

A uniquely fitted comfort pad 28 can be implanted or removed from the pocket 16. It is shown in FIG. 3 an enlarged fragmentary view of FIG. 1 showing a comfort pad 28 made of durable material that is resilient, lightweight and water proof (elastomeric foam is preferred) implanted into the pocket 16 and reaching behind the locked locking device 20 displaying the preferred embodiment of the Knee Pocket System 26. It (the comfort pad 28) is slightly smaller in its rectangular dimensions having generally smooth surfaces, generally resting flat and uniquely fitted (in all its dimensions) to the dimensions of the pocket 16 and the locking device 20 combined. Stitches 18, 22, and 24 along with the locked locking device 20 (preferably a zipper) prevent major comfort pad movement and/or dislodgment. Each pant leg 12 and 14 of pant garment 10 having identical design elements of the Knee Pocket System 26.

Figure 4:
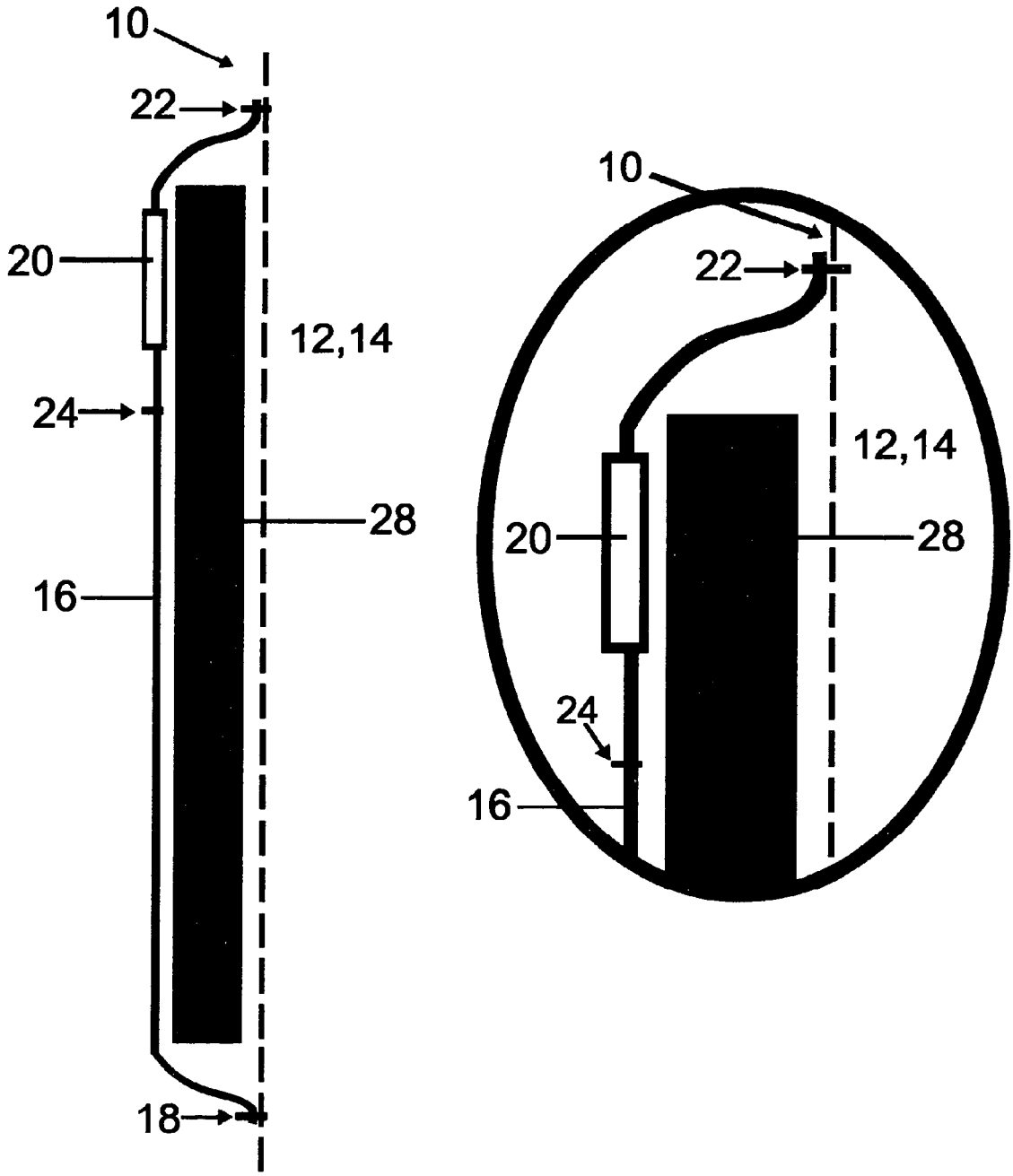
FIG. 4 is a profile view of FIG. 3 of the Knee Pocket System showing how uniquely and distinct the comfort pad is fitted within the pocket and made to fit behind the locked locking device (preferably a zipper). Included is an enlarged fragmentary view of the same profile view displaying the top area. Broken lines show structure that is not part of the claim.

A uniquely fitted comfort pad creates a distinct unique relationship with the stitches 18,22 and 24, pocket 16 and the locked locking device 20 minimizing movement and preventing dislodgment from any appropriate chosen size of the Knee Pocket System 26. The garment as shown in FIG. 4 includes a pair of pants having two pant legs that extend to the ankles; each of the two pant legs has a durable panel 16 with bottom and side perimeter edges stitched 18 to the knee portion thereof and a top perimeter edge is unattached. A bottom edge tape of a locking zipper 20 is stitched to the top perimeter edge of the durable panel 16 and a top edge tape of the locking zipper 20 extending more in length than the bottom edge tape is stitched to the pant leg defines a garment knee pocket. The locking zipper 20 extends substantially full width of the garment knee pocket forms an opening therethrough. The comfort pad 28 is positioned through the opening of the locking zipper 20 of the garment knee pocket and has an upper edge that extends substantially above the locking zipper while an outer surface thereof faces an interior surface of the durable panel and toward the top edge tape when fastened as depicted in FIG. 4.

Figure 5:
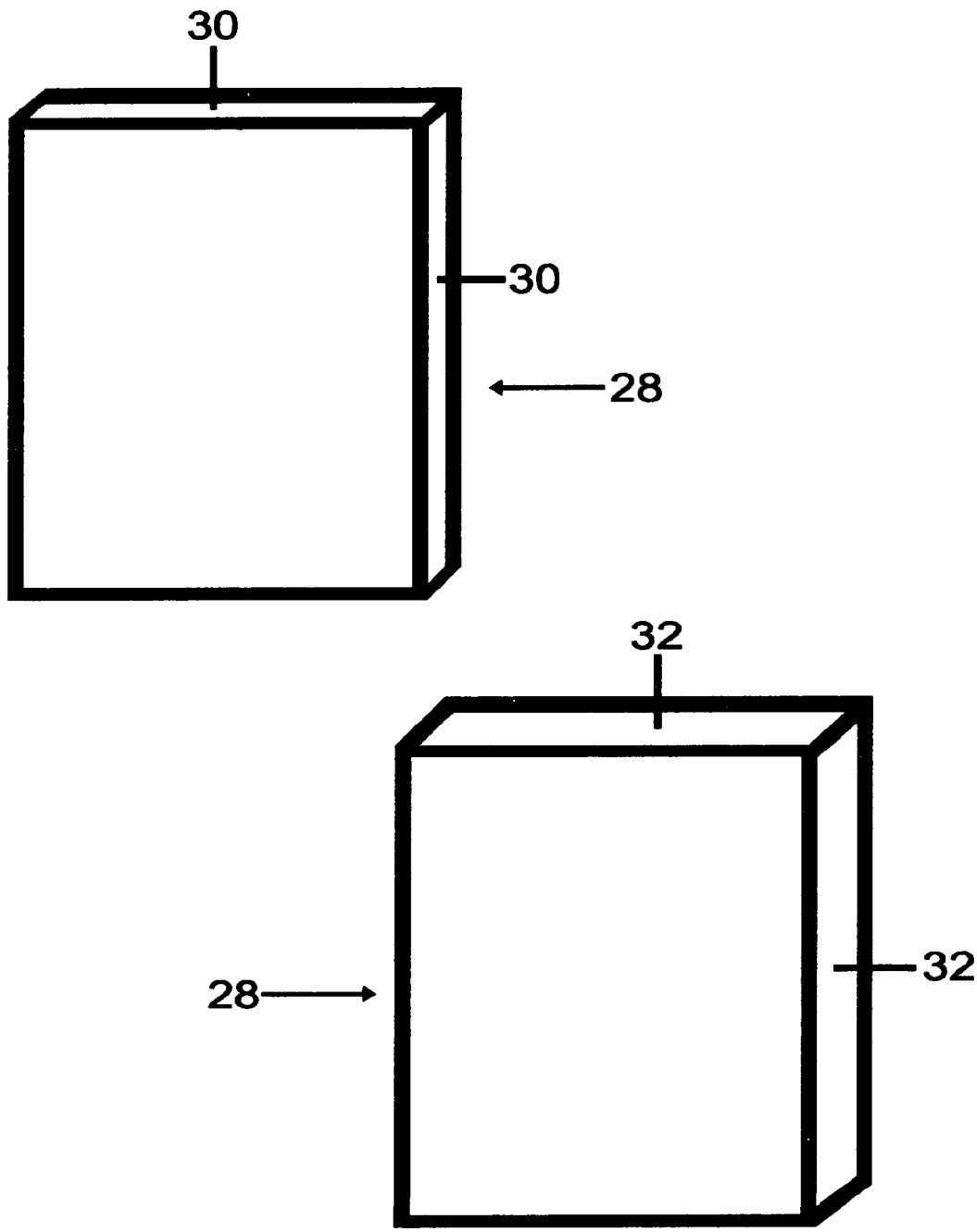
FIG. 5 is a view showing a comfort pad of two different thicknesses. These two examples are only shown to demonstrate how a comfort pad of different thickness can be applied by the user. The appropriate thickness can vary depending on the activity and on the overall chosen size of the Knee Pocket System.

A different thickness comfort pad 28 can be used (from ⅛" to ¾"). It is shown in FIG. 5 a view of the comfort pad 28 showing one example of thickness 30 for the comfort pad 28 and a second example of thickness 32 for the comfort pad 28. The examples only demonstrate that the comfort pad 28 can vary in thickness. The appropriate application of the Knee Pocket System 26 will determine the appropriate thickness of the comfort pad 28. Comfort pad 28 will have the appropriate dimensions uniquely fitted to the appropriate dimensions required by the chosen combined design elements of the chosen size of the Knee Pocket System 26.

The garment as shown in FIG. 4 includes a pair of pants having two pant legs that extends to the ankles; each of the two pants legs has the durable panel 16 with bottom and side perimeter edges stitched 18 to the knee portion thereof and a top perimeter edge is unattached. A bottom edge tape of a locking zipper 20 is stitched to the top perimeter edge of the durable panel 16 and a top edge tape of the locking zipper 20 extending more in length than the bottom edge tape is stitched to the pant leg defines a garment knee pocket. The locking zipper 20 extends substantially full width of the garment knee pocket forms an opening therethrough. The comfort pad 28 is positioned through the opening of the locking zipper 20 of the garment knee pocket and has an upper edge that extends substantially above the locking zipper while an outer surface thereof faces an interior surface of the durable panel and toward the top edge tape when fastened as depicted in FIG. 4.

I claim the invention entitled Knee Pocket System 26 as shown and described. It will be understood by those skilled in the field that modifications may be made to the said invention without departing from the scope of the said invention.

The invention claimed is:

1. A Knee protection system adapted to protect the knees from rigid surfaces during kneeling comprising: a pair of pants having two pant legs that extend to the ankles; each of the two pant legs has a durable panel with bottom and side perimeter edges stitched to the knee portion thereof and a top perimeter edge is unattached;

a bottom edge tape of a locking zipper is stitched to the top perimeter edge of the durable panel and a top edge tape of said locking zipper is stitched to the pant leg defining a garment knee pocket;

the locking zipper extends substantially full width of the garment knee pocket and defines an opening therethrough;

a dimensioned comfort pad is positioned through the opening of said locking zipper of the garment knee pocket and has an upper edge of said comfort pad extending substantially above said locking zipper while an outer surface thereof faces an interior surface of the durable panel and toward the top edge tape when fastened.

2. The Knee protection system in accordance with claim 1, wherein the garment knee pocket extends approximately from below the thighs to above the shin area without being attached to the seams of the pair of pants.

3. The Knee protection system in accordance with claim 1, wherein the durable panel is made of leather.

4. The Knee protection system in accordance with claim 1, wherein the top edge tape of the locking device extends substantially more in length than the bottom edge tape.

5. The Knee protection system in accordance with claim 1, wherein the dimensioned comfort pad is made of various thickness.

* * * * *